US006417620B1

(12) United States Patent
Yasue

(10) Patent No.: US 6,417,620 B1
(45) Date of Patent: Jul. 9, 2002

(54) SURFACE DISCHARGE PLASMA DISPLAY PANEL HAVING TWO-DIMENSIONAL BLACK STRIPES OF SPECIFIC SIZE AND SHAPE

(75) Inventor: Takao Yasue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/355,624

(22) PCT Filed: Feb. 2, 1998

(86) PCT No.: PCT/JP98/00411

§ 371 (c)(1),
(2), (4) Date: Aug. 2, 1999

(87) PCT Pub. No.: WO99/39365

PCT Pub. Date: Aug. 5, 1999

(51) Int. Cl.[7] ..... H01J 17/49

(52) U.S. Cl. ..... 313/587; 313/582; 313/584; 313/586

(58) Field of Search ..... 313/582, 583, 313/584–85, 586, 587

(56) References Cited

U.S. PATENT DOCUMENTS

| | | | | |
|---|---|---|---|---|
| 5,661,500 A | | 8/1997 | Shinoda et al. | |
| 5,742,122 A | * | 4/1998 | Wada et al. | 313/587 X |
| 5,900,694 A | * | 5/1999 | Matsuzaki et al. | 313/587 X |
| 5,939,826 A | * | 8/1999 | Obsawa et al. | 313/587 X |
| 5,952,782 A | * | 9/1999 | Nanto et al. | 313/587 X |

FOREIGN PATENT DOCUMENTS

| | | |
|---|---|---|
| EP | 0762463 A2 | 3/1997 |
| JP | 6165654 | 5/1986 |
| JP | 62268037 | 11/1987 |
| JP | 2242548 | 9/1990 |
| JP | 950767 | 2/1997 |
| JP | 9-129142 A | 5/1997 |

OTHER PUBLICATIONS

LCD Intelligence Aug. 1997.

LCD Intelligence Sep. 1997.

* cited by examiner

*Primary Examiner*—Vip Patel
*Assistant Examiner*—Mack Haynes

(57) ABSTRACT

A high performance surface discharge type PDP includes a first glass substrate having a plurality of scanning electrode pairs (X, Y) in parallel with each other and black stripes in parallel with the scanning electrode pairs formed on one main surface thereof and having a dielectric layer covering them. The PDP further includes a second glass substrate including a plurality of address electrodes W formed in parallel with each other in a direction orthogonal to the scanning electrode pairs and having a plurality of barrier ribs in parallel with the address electrodes W for abutting the dielectric layer to form discharge spaces corresponding to each of the address electrodes W. The black stripes formed on the first glass substrate have portions that each intersect with a top of a corresponding one of the plurality of barrier ribs on the second glass substrate which are cut into pieces. Consequently, clearances can be reduced in a portion where the top of the barrier rib abuts the dielectric layer, thereby narrowing an unnecessary discharge space between adjacent unit luminescent areas EU, and less defective writing results from an erroneous discharge or the like.

15 Claims, 14 Drawing Sheets

SURFACE DISCHARGE PLASMA DISPLAY PANEL HAVING TWO-DIMENSIONAL BLACK STRIPES OF SPECIFIC SIZE AND SHAPE

This application is the national phase under 35 U.S.C. §371 of PCT International Application No. PCT/JP98/00411 which has an International filing date of Feb. 2, 1999, which designated the United States of America.

TECHNICAL FIELD

The present invention relates to a surface discharge type plasma display panel (PLASMA DISPLAY PANEL) having a matrix display system, and more particularly to a structure of a black stripe formed in parallel with a scanning electrode pair in each region between pixels in order to enhance a contrast of a screen.

BACKGROUND OF THE INVENTION

FIG. 10 is an exploded perspective view showing a sectional structure of a unit pixel of an AC surface discharge type plasma display panel (hereinafter referred to as a PDP) according to the prior art described in U.S. Pat. No. 5,661,500, for example.

A PDP shown in FIG. 10 is of a surface discharge type having a three-electrode structure, and comprises a first glass substrate 1 provided on a screen side, a scanning electrode pair (X, Y) formed adjacently in parallel with each other in a transverse direction (a direction of A shown in FIG. 10) on a surface of the glass substrate 1, a dielectric layer 4 for AC driving which has a discharging protective film 5 formed on a surface thereof, a second glass substrate 6 opposed to the first glass substrate 1, a plurality of barrier ribs 7 formed in a direction orthogonal to the scanning electrode pair (X, Y) and defining a spacing dimension of a discharge space 10 by abutting on the discharging protective film 5, phosphors 9R, 9G and 9B having three primary colors of R (red), G (green) and B (blue) provided between the barrier ribs 7, address electrodes (W) provided in the second glass substrate 6 each corresponding to each of the phosphors 9R, 9G and 9B, and the like.

EU denotes unit luminescent areas each corresponding to each of the phosphors 9R, 9G and 9B. A unit pixel region EG is formed by three unit luminescent areas EU.

A discharge region is partitioned by the barrier ribs 7 for each unit luminescent area EU. The discharge space 10 thus partitioned is filled with a neon-xenon mixed gas at a pressure of about 500 Torr as a discharge gas for radiating ultraviolet rays for exciting the phosphors 9R, 9G and 9B.

Since the scanning electrode pair (X, Y) is to be provided on the screen side, it comprises band-shaped transparent conductor films (for example, a nesa film:tin oxide) 3 and metal films (for example, Ag:silver) 2 for compensating for conductive properties of the films 3.

An upper layer portion of the barrier rib 7, that is, a top 8 of the barrier rib is formed by a layer mixed with a black pigment in order to obtain the effect of enhancing contrast performance of a screen.

In such a surface discharge type PDP, a surface discharge occurs in each of intersecting portions of the scanning electrode pairs (X, Y) and the address electrodes (W) so that the unit luminescent areas EU are defined.

Accordingly, a portion corresponding to each unit luminescent area EU can be caused to selectively emit light. Thus, full color display can be obtained by the combination of R, G and B.

FIG. 11 is a plan view schematically showing a unit pixel portion of the PDP illustrated in FIG. 10.

As shown in FIG. 11, the PDP has a structure in which each unit pixel region EG constituting the screen is formed by the three unit luminescent areas EU arranged in one direction and the phosphors 9R, 9G and 9B having three colors for full color display are arranged in order corresponding to the unit luminescent areas EU.

In such a unit pixel region EG, the scanning electrode pair (X, Y) formed in the array direction of the unit luminescent area EU is arranged as electrodes for causing a surface discharge.

FIG. 12 is a plan view schematically showing another example according to the prior art in which black stripes 20 are provided between the unit pixel regions EG in parallel with the scanning electrode pairs (X, Y) in order to enhance the contrast of the screen in the conventional surface discharge type PDP described above, and FIG. 13 is an exploded perspective view showing a sectional structure of FIG. 12.

FIG. 14 is an exploded perspective view showing the first glass substrate 1 provided on the screen side in FIG. 13, which is seen from a non-screen side.

In FIGS. 13 and 14, regions enclosed by a heavy broken line indicate the black stripes 20.

FIG. 15 is a sectional view showing a state in which the first glass substrate 1 having the dielectric layer 4 and the discharging protective film 5 formed on the scanning electrode pairs (X, Y) and the black stripes 20 and the second glass substrate 6 having the barrier ribs 7 formed thereon are stuck together, which is seen just horizontally (in the A direction of FIG. 10).

In the drawings, for example, a thickness of the scanning electrode X or Y formed by the metal film 2 and the transparent conductor film 3 (that is, the sum of thicknesses of the metal film 2 and the transparent conductor film 3) is about 0.5 $\mu$m, while a thickness of the black stripe 20 is about 10 $\mu$m. The dielectric layer 4 having a thickness of about 30 $\mu$m and the discharging protective film 5 having a thickness of about 0.7 $\mu$m are formed with almost uniform thicknesses over the scanning electrodes X and Y and the black stripes 20.

For this reason, surface irregularities (concavities and convexities) are generated on the surfaces of the dielectric layer 4 and the discharging protective film 5 due to the thicknesses of the scanning electrodes X and Y and the black stripes 20 which are provided on the surface of the glass substrate 1. In particular, convex portions are enlarged over the black stripes 20.

By the way, the convex portions of the protective discharging film 5 provided above the black stripes 20 on the first substrate 1 side intersect with and abut on the tops 8 of the barrier ribs 7 provided on the second substrate 6 side. Consequently, the discharge spaces 10 are defined.

In such a conventional AC surface discharge type PDP, however, when the first substrate 1 side and the second substrate 6 side are stuck together to form the discharge spaces 10, the protective discharging film 5 provided on the first substrate 1 side abuts on the tops 8 of the barrier ribs provided on the second substrate 6 side in the convex portions generated due to the thickness of the black stripe 20 as shown in FIG. 15. Therefore, unnecessary clearances 30 are generated between the top 8 of the barrier rib and the protective discharging film 5.

The clearance 30 has a thickness of about 3 $\mu$m in a central portion between the adjacent black stripes 20 so that an extra discharge space exists in a boundary portion between the adjacent unit luminescent areas EU.

Accordingly, also in a case where surface discharge should be caused in a specific unit luminescent area, for example, a unit luminescent area EU (R) and should not be caused in unit luminescent areas EU (G) and EU (B) adjacent to both sides of the unit luminescent area EU (R), there is a problem in that the surface discharge gets over the top 8 of the barrier rib 7 through the clearance 30 which is the extra discharge space, thereby causing erroneous discharge in the unit luminescent areas EU (G) and EU (B) on both sides or affecting the surface discharge in the unit luminescent areas EU (G) and EU (B) on both sides (for example, voltage margins are reduced in the unit luminescent areas EU (G) and EU (B) on both sides), and the like.

The present invention has been made in order to eliminate the above-described drawbacks of the prior art, and has an object to provide a high performance surface discharge type PDP capable of reducing extra discharge spaces (that is, the clearances 30) generated between adjacent unit luminescent areas due to a thickness of a black stripe and of lessening defective writing caused by an erroneous discharge or the like.

DISCLOSURE OF THE INVENTION

The present invention provides a surface discharge plasma display comprising a first glass substrate having a plurality of scanning electrode pairs parallel with each other and black stripes parallel with the plurality of scanning electrode pairs formed on one main surface thereof and having a dielectric layer covering them, and a second glass substrate including a plurality of address electrodes formed in parallel with each other in a direction orthogonal to the plurality of scanning electrode pairs and having a plurality of barrier ribs parallel with the plurality of address electrodes, the plurality of barrier ribs abutting on the dielectric layer to form discharge spaces each corresponding to each of the plurality of address electrodes, wherein each of the black stripes formed on the first glass substrate has portions each intersecting with a top of corresponding one of the plurality of barrier ribs on the second glass substrate, the portions being cut into pieces. Therefore, a clearance can be reduced in a portion where the top of the barrier rib abuts on a surface of the dielectric layer, thereby narrowing an unnecessary discharge space between adjacent unit luminescent areas EU in a direction orthogonal to the barrier ribs which cause erroneous discharge. In addition, a convex portion of a surface of a discharging protective film formed on the dielectric layer, which is generated due to the black stripe, also functions as a barrier rib for separating discharge between the adjacent unit luminescent areas EU in a parallel direction with the barrier ribs, thereby preventing defective writing from being caused by the erroneous discharge or the like between the adjacent unit luminescent areas EU.

In the surface discharge plasma display according to the present invention, furthermore, the black stripes formed on the first glass substrate are constituted by a plurality of layers, at least one of the plurality of layers having portions each intersecting with the top of the corresponding one of the plurality of barrier ribs on the second glass substrate which are cut into pieces. Therefore, it is possible to prevent defective writing from being caused by the erroneous discharge or the like between the adjacent unit luminescent areas EU in horizontal and vertical directions with respect to the barrier ribs. In addition, since one of the layers of the black stripe is not cut into pieces, reliable light shielding effects can be obtained.

Moreover, the present invention provides a surface discharge plasma display comprising a first glass substrate having a plurality of scanning electrode pairs parallel with each other and black stripes parallel with the plurality of scanning electrode pairs formed on one main surface thereof and having a dielectric layer covering them, and a second glass substrate including a plurality of address electrodes formed in parallel with each other in a direction orthogonal to the plurality of scanning electrode pairs and having a plurality of barrier ribs parallel with the plurality of address electrodes, the plurality of barrier ribs abutting on the dielectric layer to form discharge spaces each corresponding to each of the plurality of address electrodes, wherein a top of each one of the plurality of barrier ribs provided on the second glass substrate includes notch portions formed in portions intersecting with the black stripes so that convex portions of the dielectric layer generated due to the black stripes formed on the first glass substrate are fitted in the notch portions. Therefore, a surface of the dielectric layer can come in contact with the tops of the barrier ribs in comparatively flat portions where the black stripe is not formed. A clearance can further be reduced in the portion where the top of the barrier rib abuts on the dielectric layer, thereby narrowing an unnecessary discharge space between adjacent unit luminescent areas EU in a direction orthogonal to the barrier ribs which cause erroneous discharge. In addition, a convex portion of a surface of a discharging protective film formed on the dielectric layer, which is generated due to the black stripe, also functions as a barrier rib for separating the discharge between the adjacent unit luminescent areas EU in a parallel direction with the barrier ribs, thereby preventing defective writing from being caused by the erroneous discharge or the like between the adjacent unit luminescent areas EU.

In the surface discharge plasma display according to the present invention, furthermore, a discharging protective film is formed on a surface of the dielectric layer. Therefore, an unnecessary discharge space can be reduced between adjacent unit luminescent areas EU, thereby lessening defective writing caused by the erroneous discharge or the like. In addition, it is also possible to obtain the effect of relaxing ion bombardment during the discharge of the dielectric layer.

In the surface discharge plasma display according to the present invention, moreover, the top of the barrier rib is formed by a layer mixed with a black pigment. Therefore, an unnecessary discharge space can be reduced between adjacent unit luminescent areas EU, thereby lessening defective writing caused by the erroneous discharge or the like. In addition, a contrast of a screen can also be enhanced.

BEST MODE FOR CARRYING OUT THE INVENTION

Figure 1:
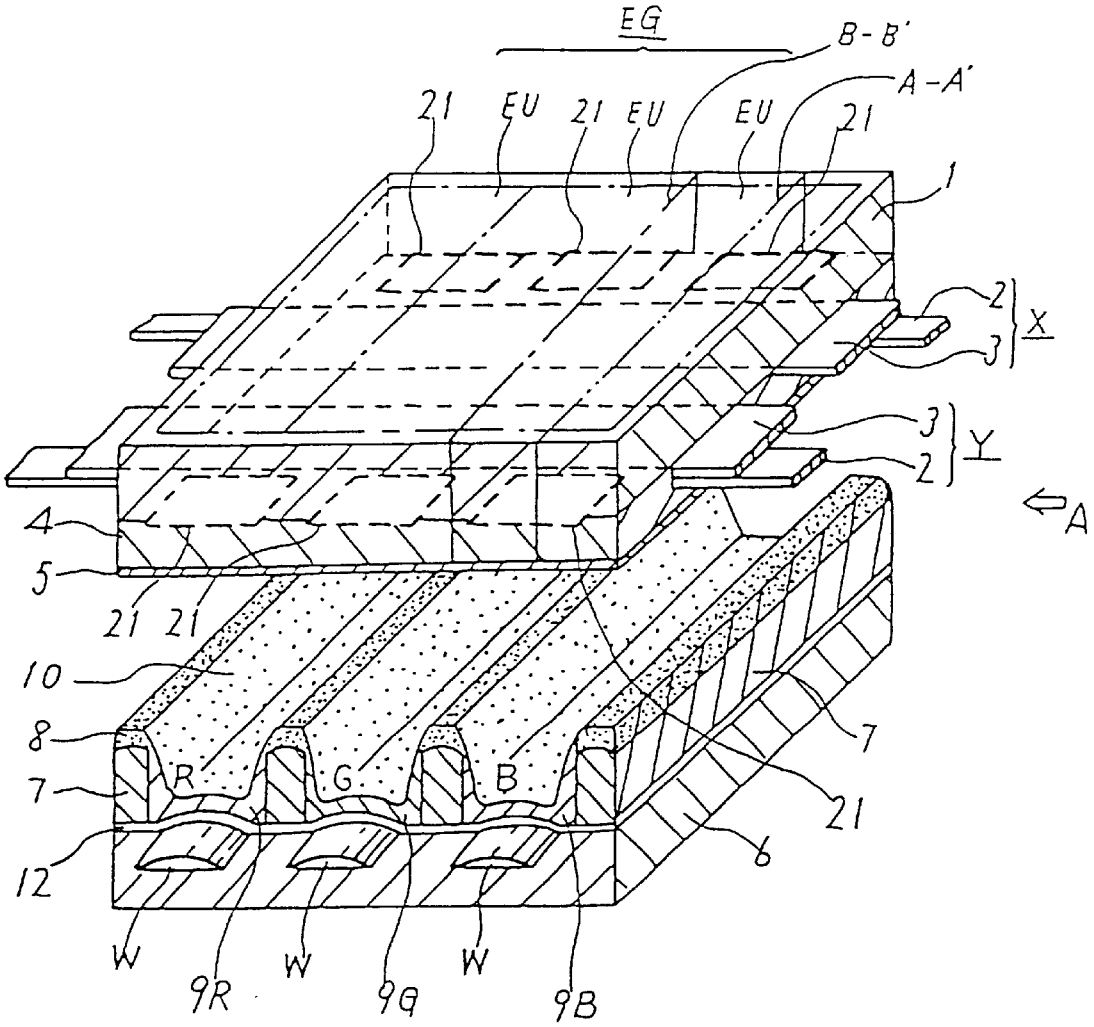
FIG. 1 is an exploded perspective view showing a sectional structure of a unit pixel of a surface discharge type PDP according to a first embodiment of the present invention.

The present invention will be described in more detail with reference to the accompanying drawings.

In the drawings, the same reference numerals as those in the prior art denote the same or corresponding portions in the prior art.

First Embodiment

FIG. 1 is an exploded perspective view showing a sectional structure of a surface discharge type plasma display according to a first embodiment of the present invention.

As shown in FIG. 1, the surface discharge type PDP according to the first embodiment comprises a first glass substrate 1 provided on a screen side, scanning electrode pairs (X, Y) formed adjacently in parallel with each other in a transverse direction (a direction of A shown in FIG. 1) on a surface of the first glass substrate, black stripes 21 (regions enclosed by heavy broken lines) formed in parallel with the scanning electrode pair (X, Y) and having portions intersecting with and abutting on barrier ribs 7 which are cut into pieces, a dielectric layer 4 for AC driving which has a discharging protective film 5 formed on a surface thereof, a second glass substrate 6 opposed to the first glass substrate 1, a plurality of barrier ribs 7 formed above a surface of the second glass substrate 6 in a direction orthogonal to the scanning electrode pair (X, Y) formed on the surface of the first glass substrate 1 and defining a spacing dimension of a discharge space by abutting on the discharging protective film 5, phosphors 9R, 9G and 9B having three primary colors of R (red), G (green) and B (blue) provided between the barrier ribs 7, address electrodes (W) provided in the second glass substrate 6 each corresponding to each of the phosphors 9R, 9G and 9B, and the like.

The reference numeral 8 denotes a top of the barrier rib 7. EU denotes unit luminescent areas each corresponding to each of the phosphors 9R, 9G and 9B. A unit pixel region EG is formed by three unit luminescent areas EU.

A discharge region is partitioned by the barrier ribs 7 for each unit luminescent area EU. A discharge space 10 thus partitioned is filled with a neon-xenon mixed gas at a pressure of about 500 Torr as a discharge gas for radiating ultraviolet rays for exciting the phosphors 9R, 9G and 9B.

Furthermore, EU denotes unit luminescent areas each corresponding to each of the phosphors 9R, 9G and 9B. A unit pixel region EG is formed by three unit luminescent areas EU.

Since the scanning electrode pair (X, Y) is to be provided on the screen side, it comprises band-shaped transparent conductor films (for example, a nesa film:tin oxide) 3 and metal films (for example, Ag:silver) 2 for compensating for conductive properties of the films 3.

An upper layer portion of the barrier rib 7, that is, the top 8 of the barrier rib is formed by a layer mixed with a black pigment in order to enhance contrast performance of a screen.

In the same manner as in the PDP according to the above-described prior art, a surface discharge occurs in each of intersecting portions of the scanning electrode pairs (X, Y) and the address electrodes (W) so that the unit luminescent areas EU are defined in the PDP according to the present embodiment.

Figure 2:
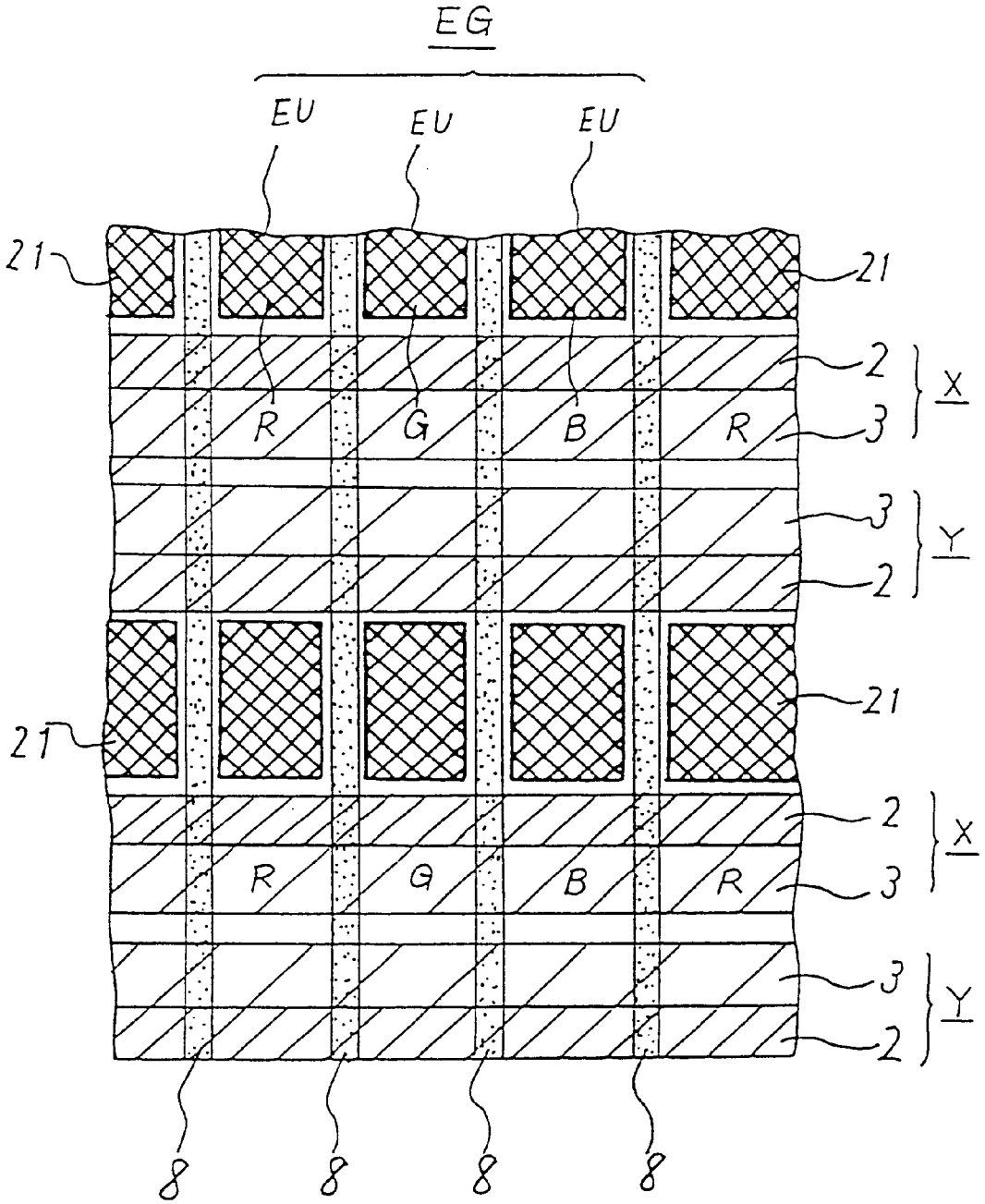
FIG. 2 is a schematic plan view showing a unit pixel portion of the surface discharge type PDP according to the first embodiment.

Accordingly, a portion corresponding to each unit luminescent area EU can be caused to selectively emit light. Thus, full color display can be performed by the combination of R, G and B. FIG. 2 is a plan view schematically showing a unit pixel portion of the surface discharge type PDP according to the first embodiment illustrated in FIG. 1.

As shown in FIG. 2, the PDP according to the present embodiment also has a structure in which each unit pixel region EG constituting a screen is formed by three unit luminescent areas EU arranged in one direction and the phosphors 9R, 9G and 9B having three colors for full color display are arranged in order corresponding to the unit luminescent areas EU.

In such a unit pixel region EG, the scanning electrode pair (X, Y) formed in the array direction of the unit luminescent area EU is arranged as electrodes for causing surface discharge.

As is apparent from FIG. 2, the black stripe 21 formed in parallel with the scanning electrode X or Y is cut into pieces in portions which intersect with and abut on the tops 8 of the barrier ribs in the present embodiment. The cut portion is filled with the top 8 of the barrier rib which is provided on the barrier rib 7 and is formed by a layer mixed with a black pigment. Therefore, light shielding properties can be kept for the time being. As seen from the screen side, consequently, a contrast can be prevented from being deteriorated by cutting the black stripe into pieces.

Figure 3:
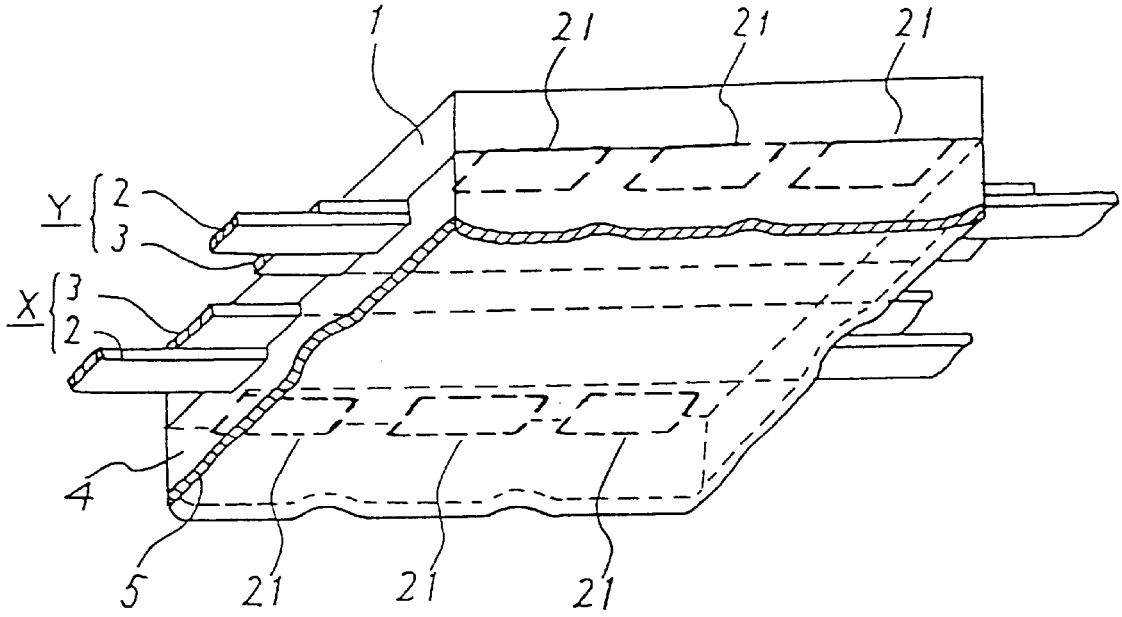
FIG. 3 is an exploded perspective view showing a first glass substrate in the surface discharge type PDP according to the first embodiment, which is seen from a non-screen side.

FIG. 3 is an exploded perspective view showing the first glass substrate 1 provided on the screen side, which is seen from a non-screen side.

In FIG. 3, a region enclosed by a heavy broken line indicates the divided black stripe 21.

In the same manner as in the prior art, for example, thicknesses of the scanning electrodes X and Y each formed by the metal film 2 and the transparent conductor film 3 (that is, the sum of thicknesses of the metal film 2 and the transparent conductor film 3) is about 5 μm, while a thickness of the black stripe 20 formed by the division is about 10 μm. The dielectric layer 4 having a thickness of about 30 μm and the discharging protective film 5 having a thickness of about 0.7 μm are formed with almost uniform thicknesses over the scanning electrodes X and Y and the black stripes 21.

For this reason, concavities and convexities are generated on the surfaces of the dielectric layer 4 and the discharging protective film 5 due to the thicknesses of the scanning electrode pairs (X, Y) and the black stripes 21 which are provided on the surface of the glass substrate 1. In particular, large convex portions are generated due to the black stripes 21.

Although large convex portions are generated on the surface of the discharging protective film 5 in portions corresponding to the black stripes 21, no convex portions are generated on the cut portions of the black stripes 21 because the black stripe 21 is not formed (i.e., is cut into pieces) in portions where the discharging protective film 5 intersects with and abuts on the tops 8 of the barrier ribs as shown in FIG. 3.

Figure 4A:
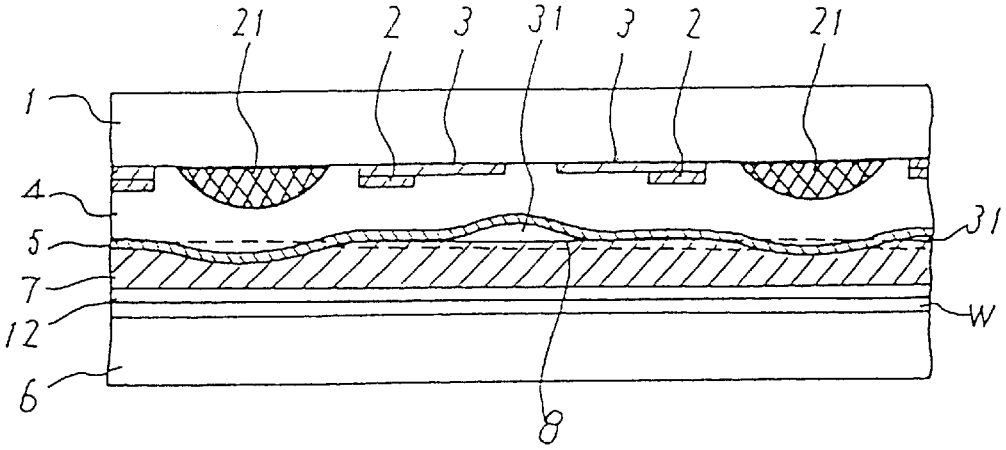
FIGS. 4*a* and 4*b* are sectional views showing a state in which the first glass substrate and a second glass substrate in the surface discharge type PDP according to the first embodiment are stuck together.
Figure 4B:
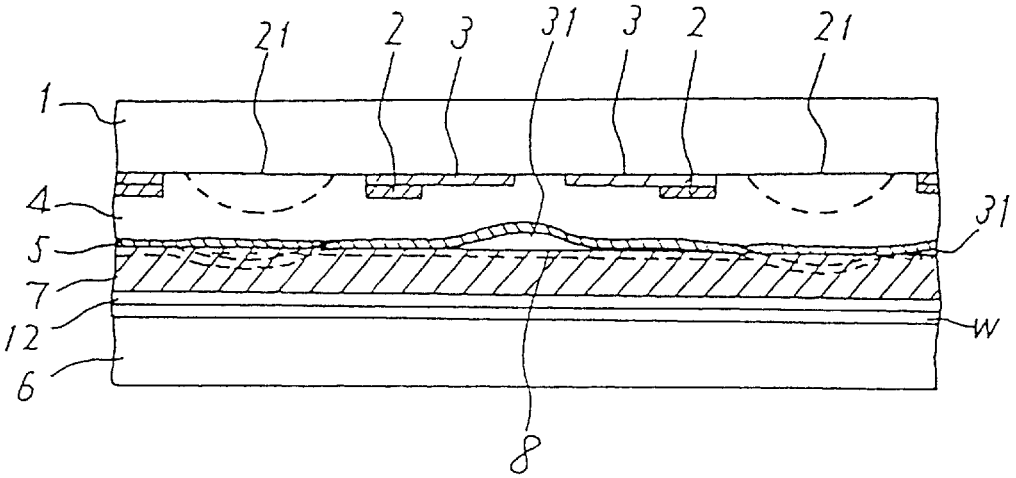

FIGS. 4*a* and 4*b* are sectional views showing a state in which the first glass substrate 1 having the dielectric layer 4 and the discharging protective film 5 formed on the scanning electrode pairs (X, Y) and the black stripes 21 and the second glass substrate 6 having the barrier ribs 7 formed thereon are stuck together, which is seen just horizontally (in the A direction of FIG. 1), FIG. 4(*a*) showing a section of an A–A' portion in FIG. 1 and FIG. 4(*b*) showing a section of a B–B' portion in FIG. 1.

In the drawing, the reference numeral 31 denotes a clearance which is an unnecessary discharge space generated on a portion where the top 8 of the barrier rib 7 abuts on the surface of the discharging protective film 5.

Figure 15:
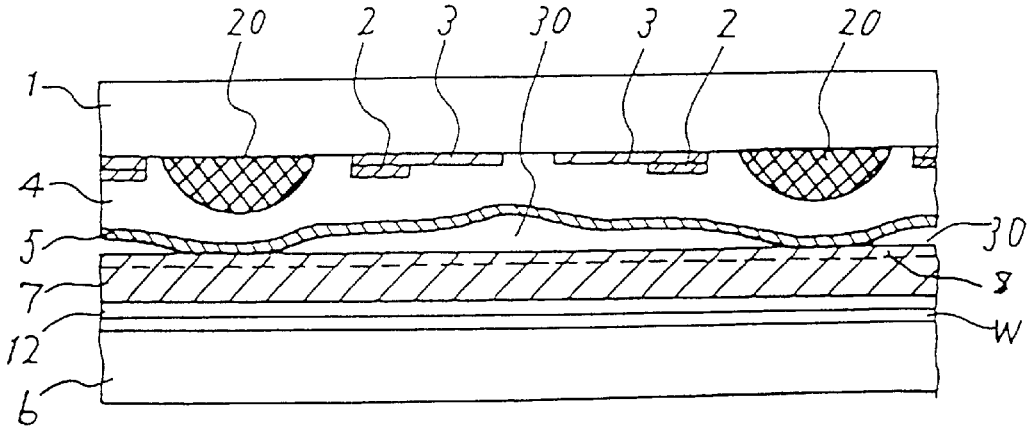
FIG. 15 is a sectional view showing a state in which the first glass substrate 1 and a second glass substrate 6 are stuck together in the surface discharge type PDP illustrated in FIG. 13.

As is more apparent than in FIG. 2, the black stripe 21 is cut into pieces and is not formed in the portions where the surface of the discharging protective film 5 formed on the dielectric layer 4 intersects with and abuts on the tops 8 of the barrier ribs 7 in the present embodiment. Therefore, no convex portion is generated due to the black stripe 21. Accordingly, the clearances 31 generated in the portion where the discharging protective film 5 formed on the surface of the dielectric layer 4 abuts on the top 8 of the barrier rib 7 as shown in FIG. 4(*b*) are reduced more considerably than the clearances 30 shown in FIG. 15 according to the prior art.

The convex portion of the surface of the discharging protective film 5 formed on the dielectric layer 4, which is generated due to the black stripe 21, also functions as a barrier rib for separating the discharge between the adjacent unit luminescent areas EU provided in a parallel direction with the barrier ribs 7 (that is, in a direction orthogonal to the scanning electrodes X and Y), and can also prevent defective writing from being caused by the erroneous discharge or the like between the adjacent unit luminescent areas EU in the parallel direction with the barrier ribs 7.

According to the present embodiment, thus, it is possible to reduce unnecessary discharge spaces (clearances 31) between the adjacent unit luminescent areas EU in a direction orthogonal to the barrier ribs 7 and to separate the discharge between the adjacent unit luminescent areas EU in the parallel direction with the barrier ribs 7. Therefore, it is possible to implement a high performance surface discharge type PDP having less defective writing caused by the erroneous discharge or the like.

Furthermore, the discharging protective film 5 is formed on the surface of the dielectric layer 4. Consequently, it is also possible to obtain the effect of relaxing ion bombardment during the discharge of the dielectric layer 4.

While the case where the discharging protective film 5 is formed on the surface of the dielectric layer 4 has been described in the present embodiment, the discharging protective film 5 is not always essential and is not formed in some cases.

Second Embodiment

Figure 5:
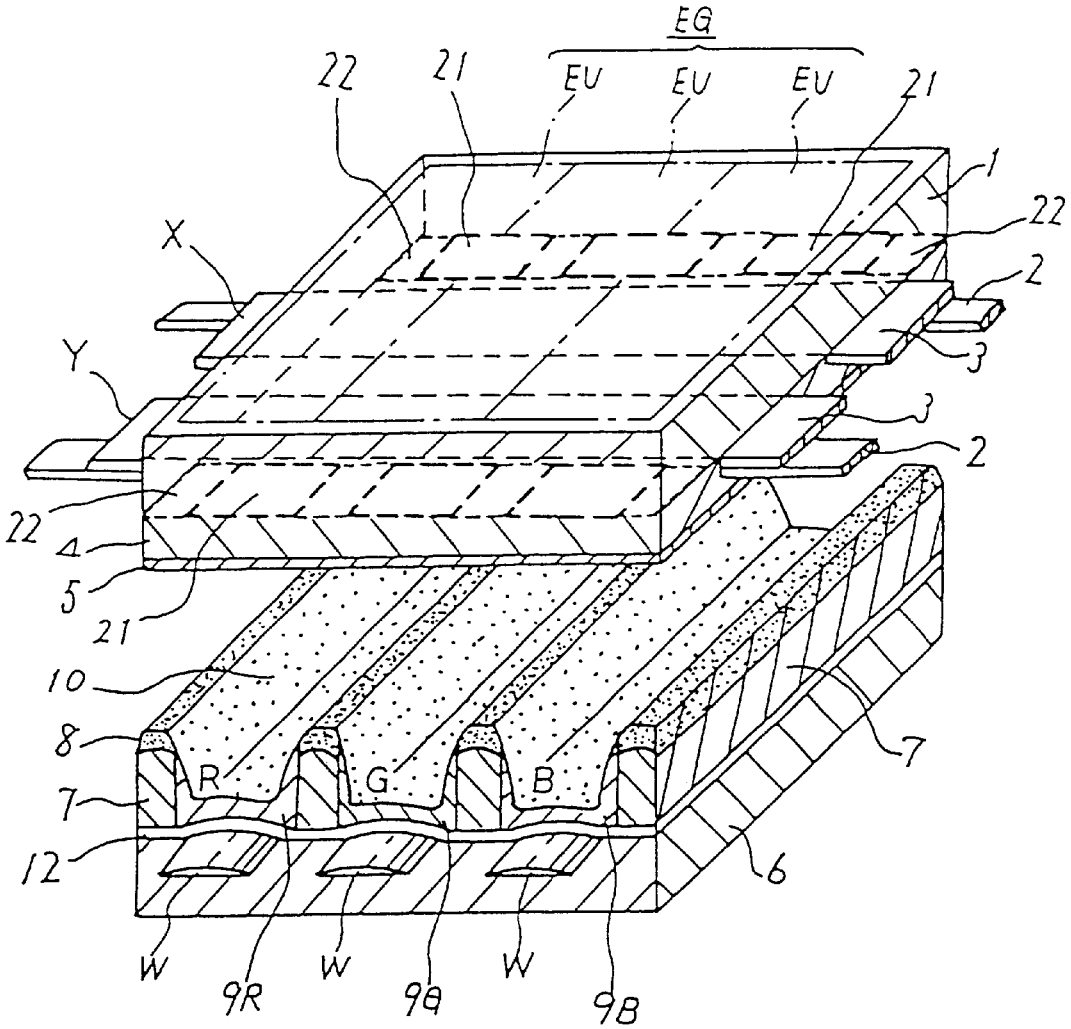
FIG. 5 is an exploded perspective view showing a sectional structure of a unit pixel of a surface discharge type PDP according to a second embodiment of the present invention.
Figure 6:
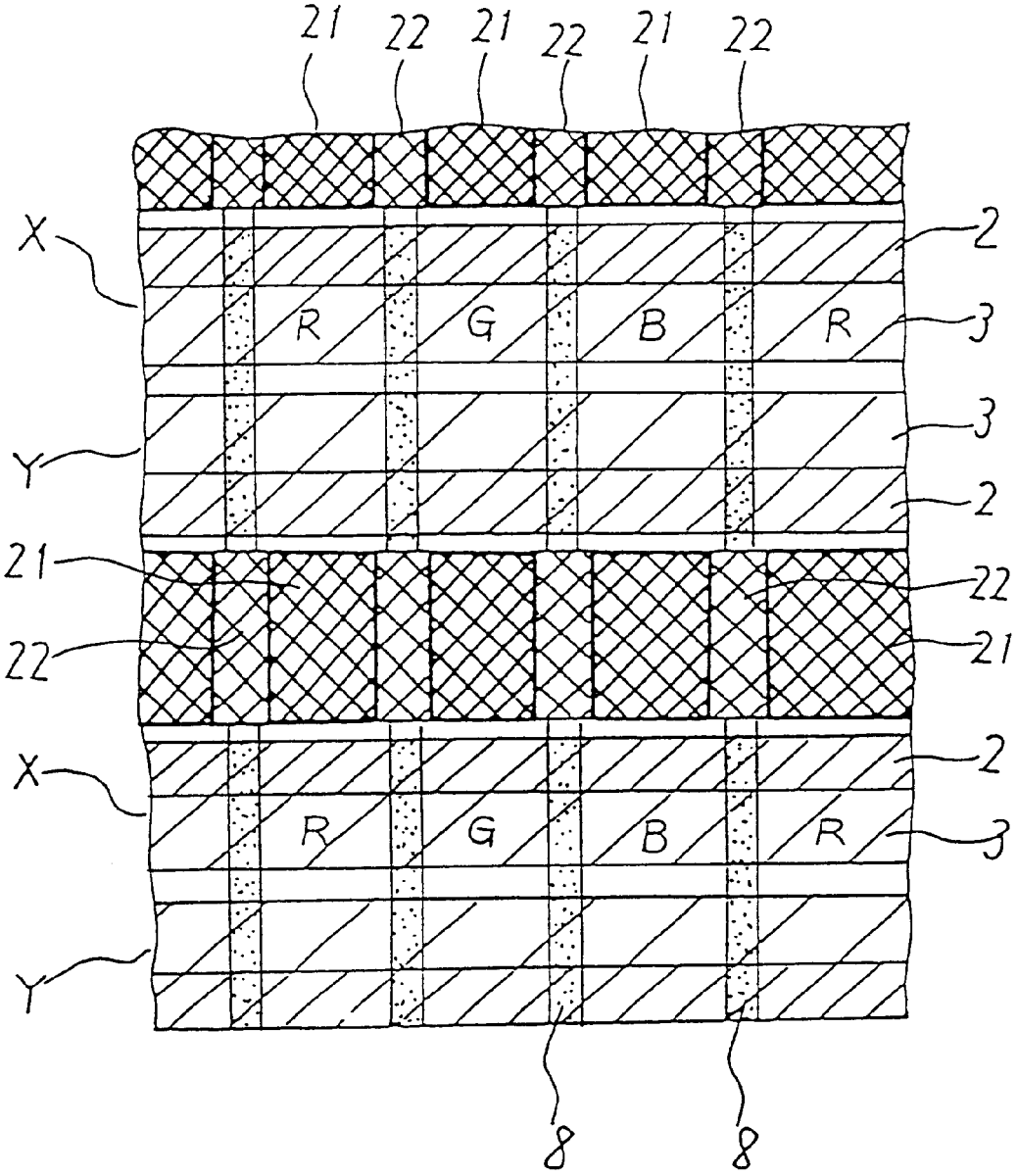
FIG. 6 is a schematic plan view showing a unit pixel portion of the surface discharge type PDP according to the second embodiment.
Figure 7:
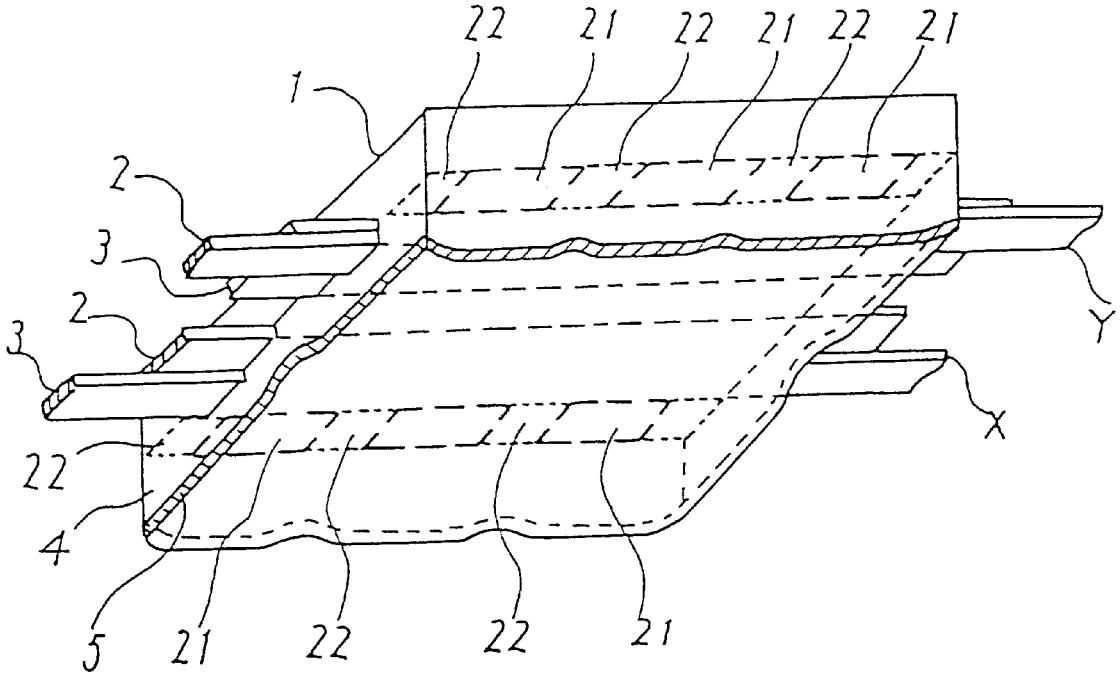
FIG. 7 is an exploded perspective view showing a first glass substrate 1 in the surface discharge type PDP according to the second embodiment, which is seen from a non-screen side.

FIG. 5 is an exploded perspective view showing a sectional structure of a surface discharge type plasma display according to a second embodiment of the present invention, FIG. 6 is a plan view schematically showing a unit pixel portion of the surface discharge type PDP according to the second embodiment illustrated in FIG. 5, and FIG. 7 is an exploded perspective view showing a first glass substrate 1 in the surface discharge type PDP according to the second embodiment, which is seen from a non-screen side.

A basic structure according to the present embodiment is almost the same as that in the first embodiment, and is characterized in that a black stripe has a different structure and is formed to have a plurality of layers.

In the drawing, the reference numeral 21 denotes a black stripe which is cut into pieces in portions where a discharging protective film 5 intersects with and abuts on tops 8 of barrier ribs 7 in the same manner as in the first embodiment, and the reference numeral 22 denotes a black stripe which has a uniform thickness without cutting into pieces and is formed in parallel with the scanning electrode pair (X, Y) in the same manner as the black stripe 20 according to the prior art. The black stripe 21 is stacked over the black stripe 22.

For example, the black stripe 22 has a thickness of about 1 μm to several μm, and a portion where the black stripe 21 is provided on the black stripe 22 (that is, a portion which does not abut on the top 8 of the barrier rib 7) has the same thickness of about 10 μm as the thickness of the black stripe 20 according to the prior art.

In the surface discharge type PDP according to the first embodiment, by the way, the portion of the black stripe 21 which intersects with and abuts on the top 8 of the barrier rib 7 is cut into pieces. Therefore, the cut portion has no light shielding effect.

Furthermore, in the surface discharge type PDP according to the first embodiment, the cut portion of the black stripe 21 should surely intersect with the barrier rib 7.

More specifically, it is necessary to perform alignment for the first glass substrate 1 including the black stripes 21 and the second glass substrate 6 including the barrier ribs 7 with high precision.

In the surface discharge type PDP according to the first embodiment, accordingly, if a shift of alignment occurs, it is necessary to compensate for the light shielding properties of the cut portion.

As in the present embodiment, it is also possible to obtain reliable light shielding effects by causing the black stripe to be two-layered and compensating for a black fault part of the cut portion of the black stripe 21 with the black stripe 22.

In the same manner as in the first embodiment described above, a clearance 31 (not shown) can be reduced in a portion where the top 8 of the barrier rib abuts on the discharging protective film 5 formed on a surface of a dielectric layer 4. Therefore, an unnecessary discharge space (the clearance 31) can be reduced between the adjacent unit luminescent areas EU in a direction orthogonal to the barrier rib 7. In addition, a convex portion of a surface of the discharging protective film 5 formed on the dielectric layer 4, which is generated due to the cut black stripe 21, also functions as a barrier rib for separating the discharge between the adjacent unit luminescent areas EU in a parallel direction with the barrier rib 7 (that is, a direction orthogonal to the scanning electrodes X and Y), and defective writing can also be prevented from being caused by an erroneous discharge or the like between the adjacent unit luminescent areas EU.

According to the present embodiment, thus, it is possible to implement a higher performance surface discharge type PDP in which reliable light shielding properties can be kept even if a shift of alignment occurs and less defective writing is caused by the erroneous discharge or the like between the adjacent unit luminescent areas.

While the case where the uncut black stripe 22 having a uniform thickness is first formed on a surface of the first glass substrate 1 and the cut black stripe 21 is then formed on the black stripe 22 is described in the second embodiment, the cut black stripe 21 may be first formed and the uncut black stripe 22 having a uniform thickness may be then formed on the black stripe 21.

Although the black stripe 22 comprising one layer is used to prevent a black fault and the black stripe 21 comprising one layer is used to reduce the convex portion generated on the surface in the second embodiment, each of the black stripes 21 and 22 does not need to have only one layer but may be multilayered to obtain the same effects.

While the case where the discharging protective film 5 is formed on the surface of the dielectric layer 4 has been described in the present embodiment, the discharging protective film 5 is not always essential and is not formed in some cases.

Third Embodiment

In the first and second embodiments, there has been described the example in which the black stripe is cut into pieces to reduce the clearances in the portions where the tops of the barrier ribs abut on the discharging protective film and to narrow extra discharge spaces between the adjacent unit luminescent areas EU, thereby preventing defective writing from being caused by erroneous discharge. In the present embodiment, however, there will be described a case where notch portions are provided in a barrier rib to reduce the extra discharge spaces, for example.

Figure 8:
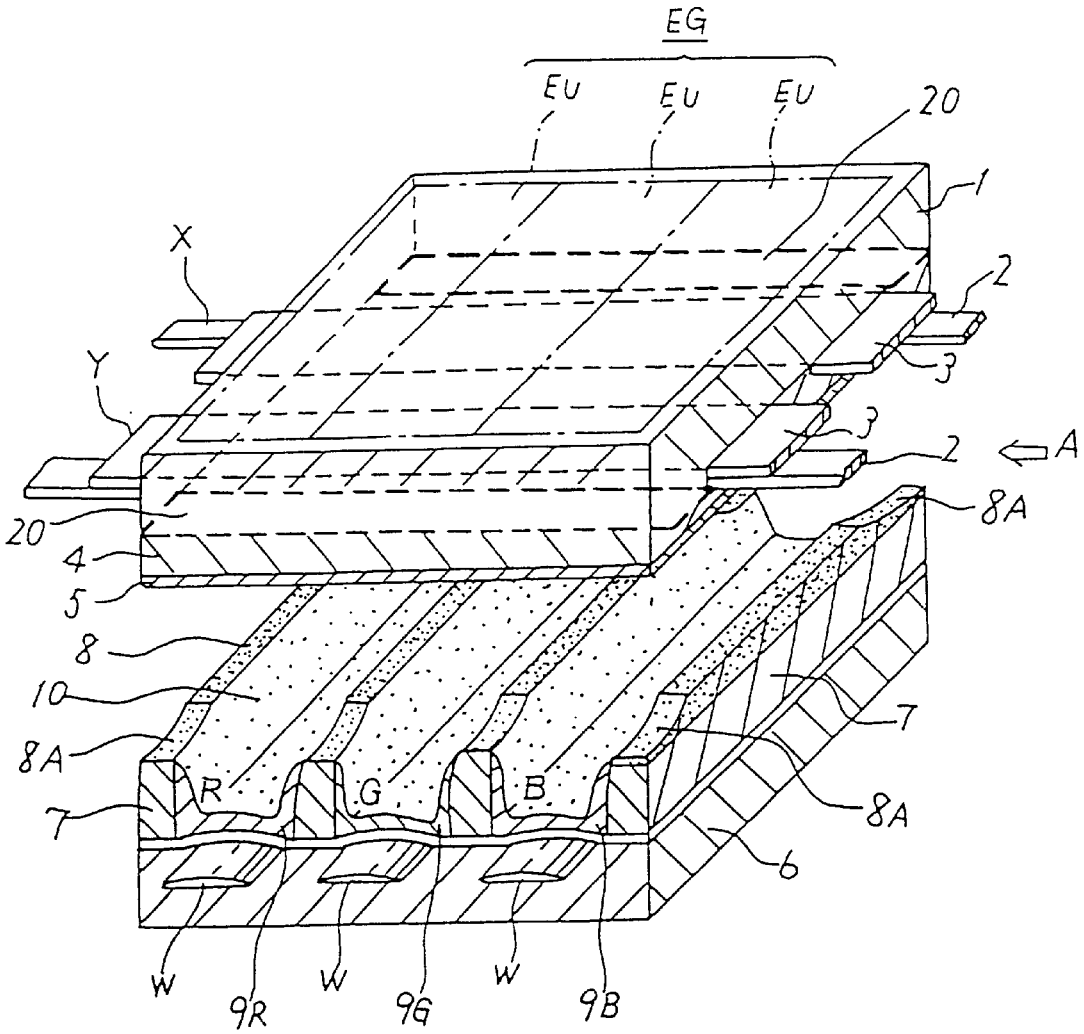
FIG. 8 is an exploded perspective view showing a sectional structure of a surface discharge type PDP according to a third embodiment of the present invention.

FIG. 8 is an exploded perspective view showing a sectional structure of a surface discharge type PDP according to a third embodiment of the present invention.

As shown in the drawing, in the same manner as in the surface discharge type PDP according to the prior art, a first glass substrate 1 side of the surface discharge type PDP according to the third embodiment comprises a first glass substrate 1 provided on a screen side, scanning electrode pairs (X, Y) formed adjacently in parallel with each other in a transverse direction (a direction of A shown in FIG. 8) on a surface of the glass substrate 1, a dielectric layer 4 for AC driving which has a discharging protective film 5 formed on a surface thereof, a second glass substrate 6 opposed to the first glass substrate 1, a plurality of barrier ribs 7 formed in a direction orthogonal to the scanning electrode pair (X, Y) and defining a spacing dimension of a discharge space 10 by abutting on the discharging protective film 5 formed on the surface of the dielectric layer, phosphors 9R, 9G and 9B having three primary colors of R (red), G (green) and B (blue) provided between the barrier ribs 7, address electrodes (W) provided in the second glass substrate 6 each corresponding to each of the phosphors 9R, 9G and 9B, and the like.

EU denotes unit luminescent areas each corresponding to each of the phosphors 9R, 9G and 9B. A unit pixel region EG is formed by three unit luminescent areas EU.

A discharge region is partitioned by the barrier ribs 7 for each unit luminescent area EU. The discharge space 10 thus partitioned is filled with a neon-xenon mixed gas at a pressure of about 500 Torr as a discharge gas for radiating ultraviolet rays for exciting the phosphors 9R, 9G and 9B.

Since the scanning electrode pair (X, Y) is to be provided on the screen side, it comprises band-shaped transparent conductor films 3 and metal films 2 for compensating for conductive properties of the films 3.

Furthermore, black stripes 20 having a thickness of about 10 $\mu$m are formed in parallel with the scanning electrode pairs (X, Y) without cutting into pieces in regions between the unit pixel regions EG in order to enhance a contrast of a screen.

An upper layer portion of the barrier rib 7 (that is, a top 8 of the barrier rib 7) is formed by a layer mixed with a black pigment in order to obtain the effect of enhancing contrast performance of the screen. The present embodiment is characterized in that a notch portion 8A is provided in a portion of the top 8 of the barrier rib which intersects with and abuts on the black stripe 20.

Figure 9:
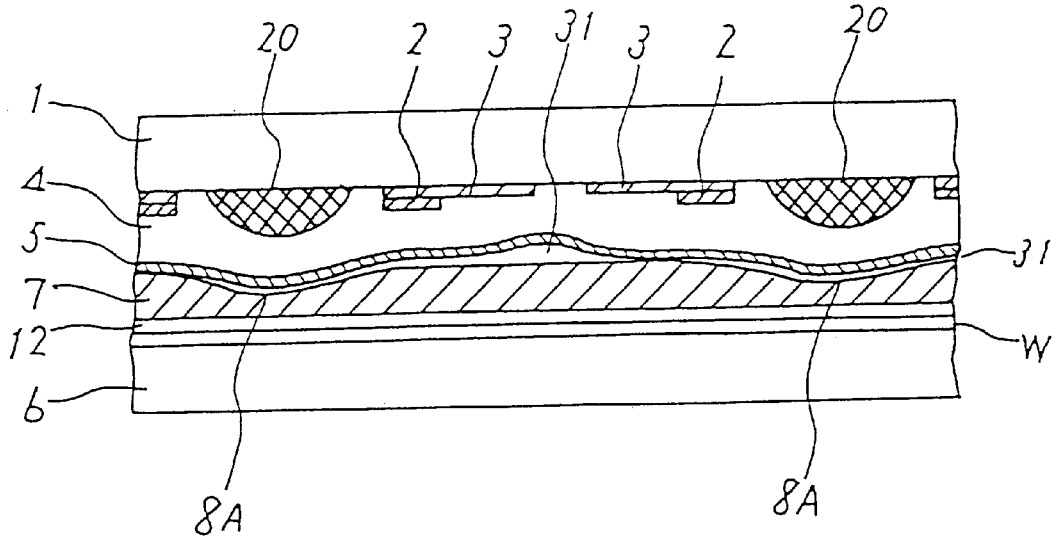
FIG. 9 is a sectional view showing a state in which a first glass substrate 1 and a second glass substrate 6 are stuck together.
Figure 10:
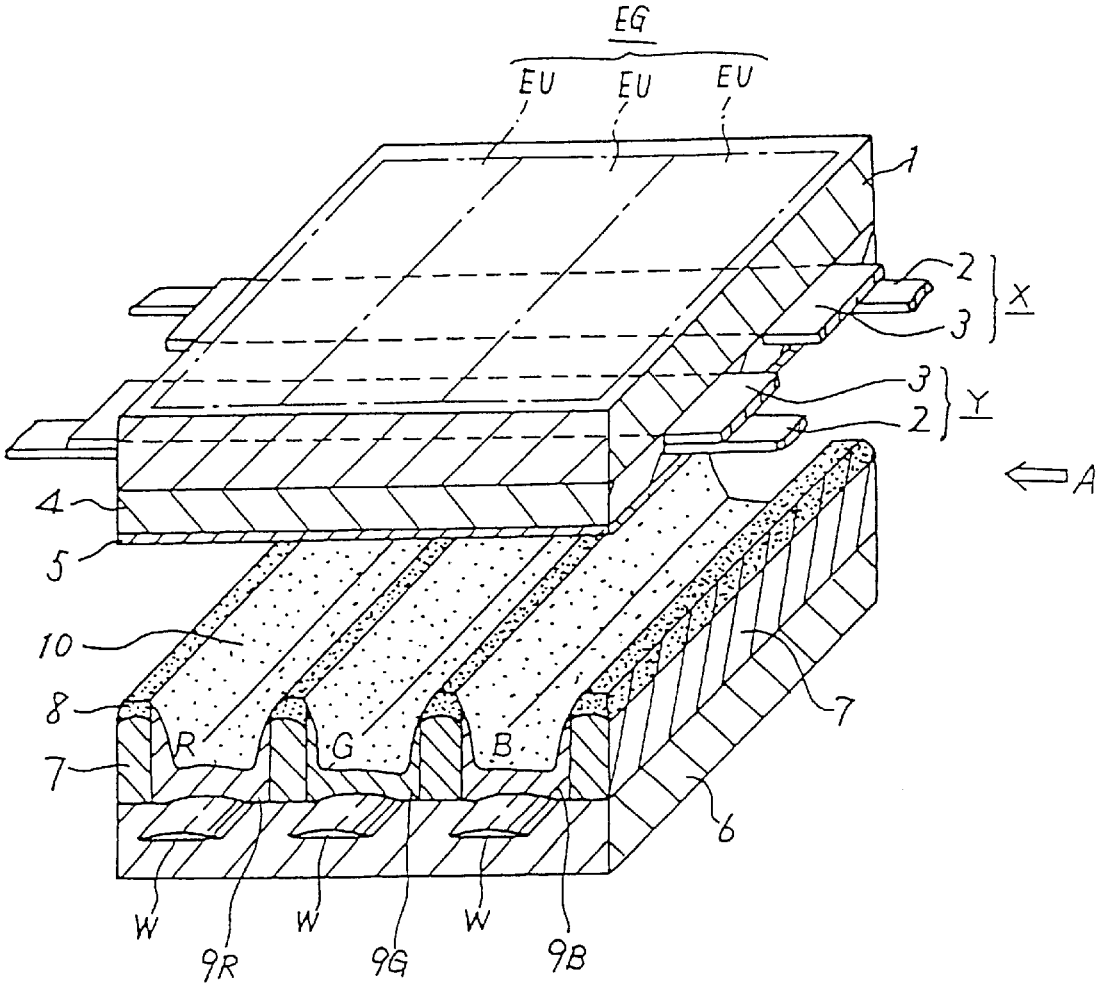
FIG. 10 is an exploded perspective view showing a sectional structure of a unit pixel of a surface discharge type PDP according to the prior art.
Figure 11:
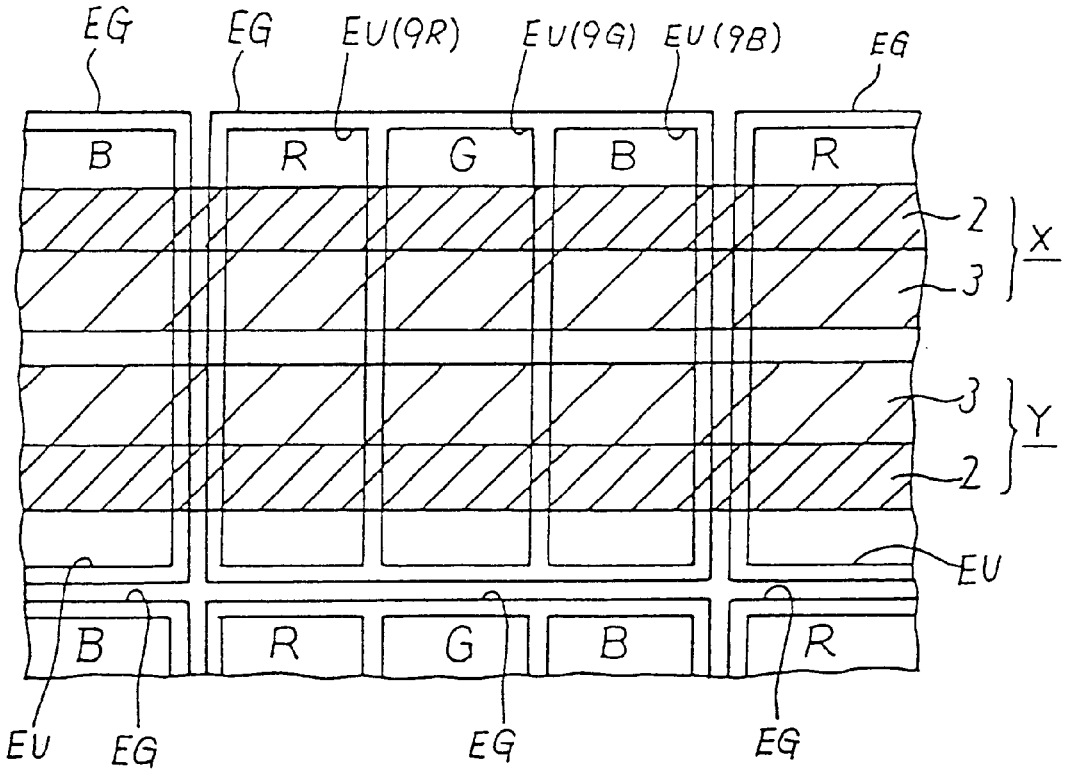
FIG. 11 is a schematic plan view showing a unit pixel portion of the surface discharge type PDP according to the prior art.
Figure 12:
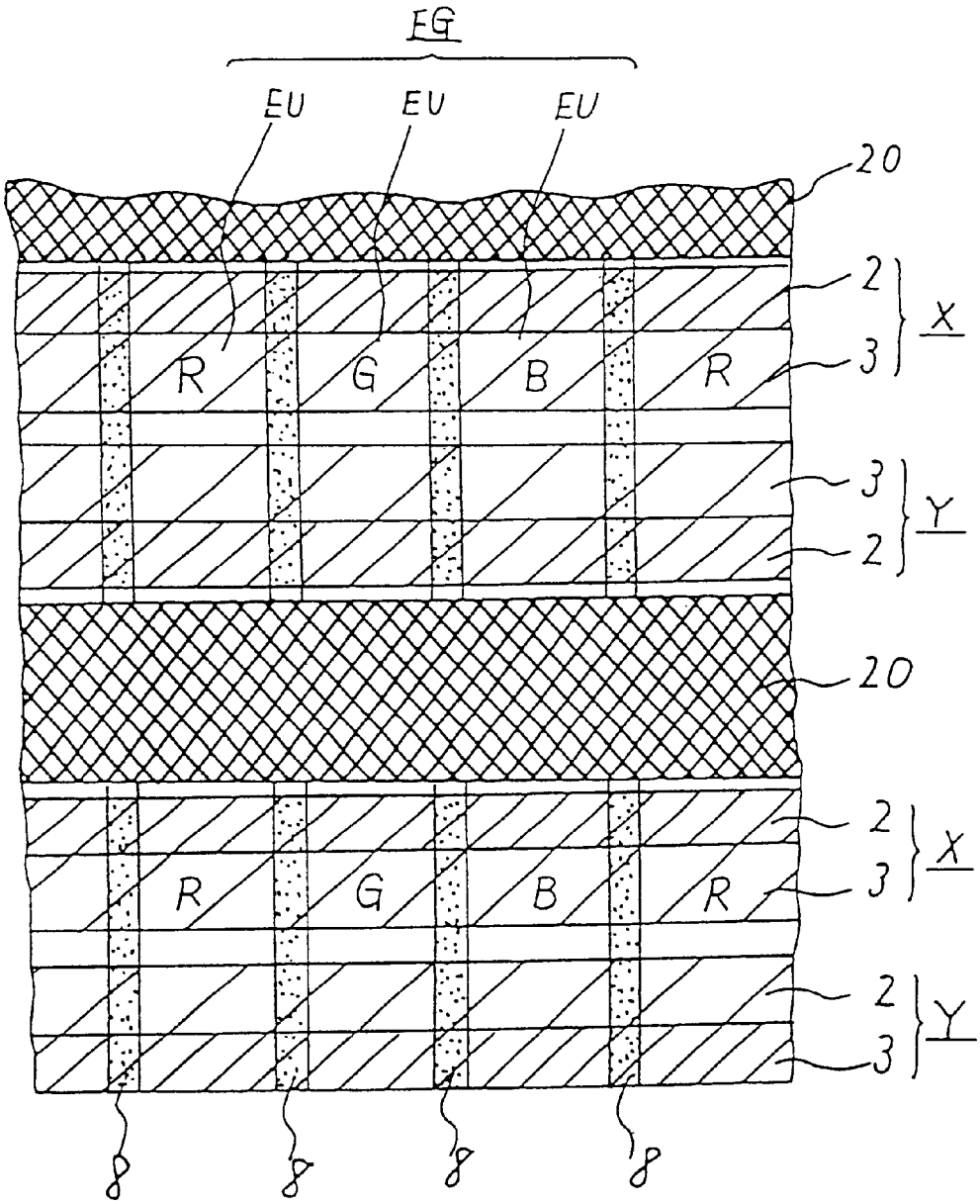
FIG. 12 is a schematic plan view showing the unit pixel portion of the surface discharge type PDP according to the prior art in which black stripes are provided.
Figure 13:
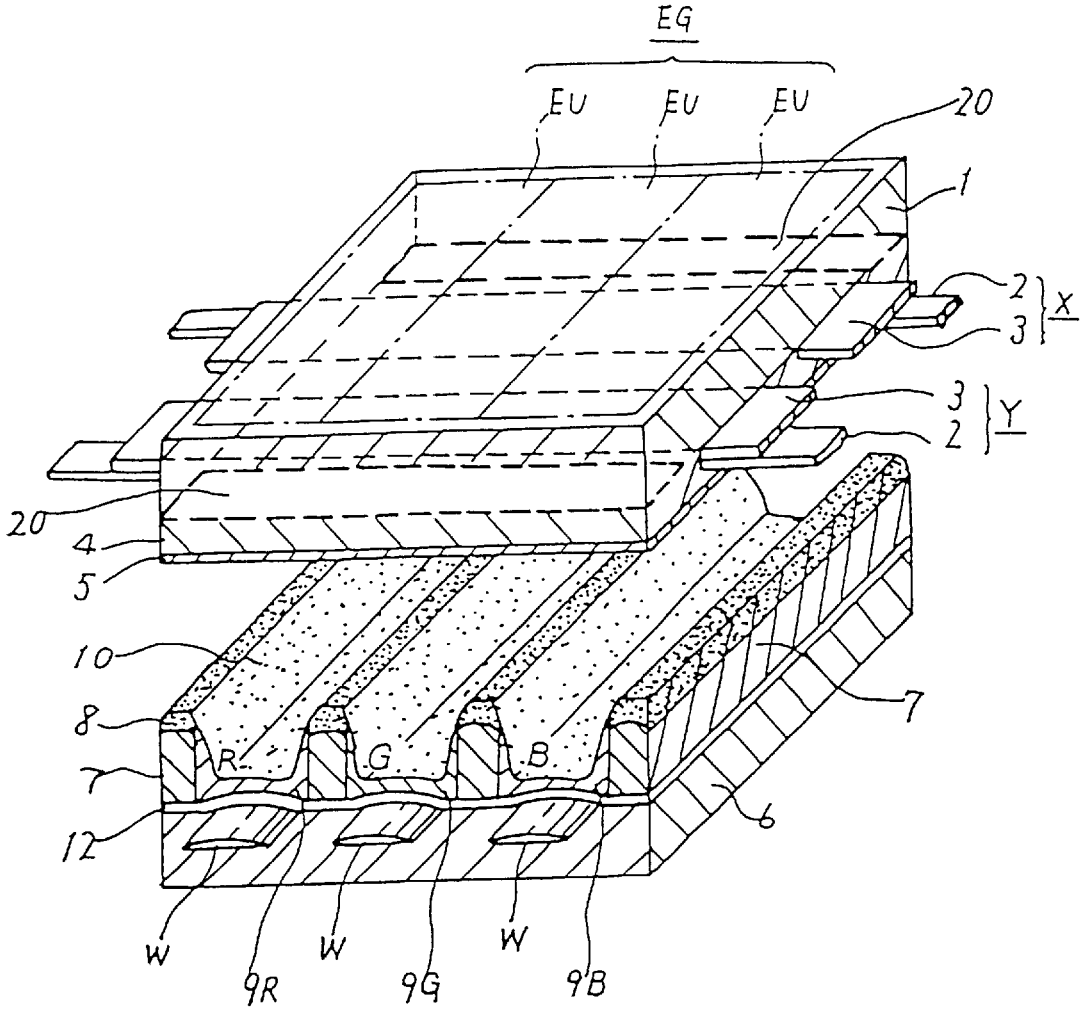
FIG. 13 is an exploded perspective view showing a sectional structure of the unit pixel portion of the surface discharge type PDP illustrated in FIG. 12.
Figure 14:
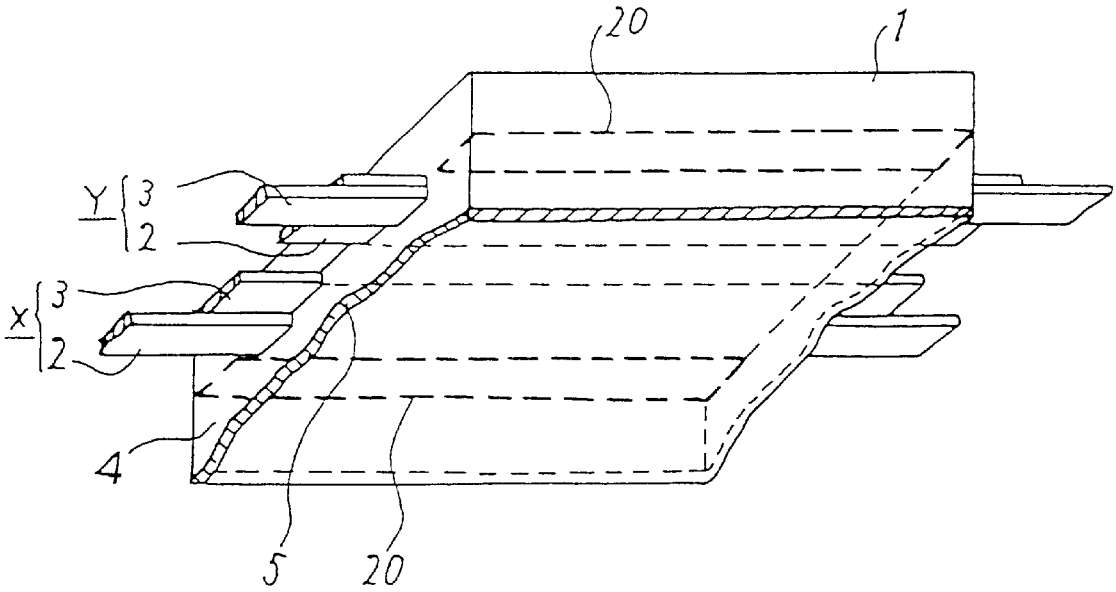
FIG. 14 is an exploded perspective view showing a first glass substrate 1 in the surface discharge type PDP illustrated in FIG. 13, which is seen from a non-screen side.

FIG. 9 is a sectional view showing a state in which the first glass substrate 1 and the second glass substrate 6 are stuck together, which is seen just horizontally (in the A direction of FIG. 8).

As is apparent from the drawing, the notch portion 8A provided on the top 8 of the barrier rib is formed such that a convex portion of the discharging protective film 5 generated due to the thickness of the black stripe 20 is exactly fitted in and abuts on the notch portion 8A when the first glass substrate 1 and the second glass substrate 6 are stuck together.

In the present embodiment, consequently, the discharging protective film 5 formed on the surface of the dielectric layer 4 comes in contact with the top 8 of the barrier rib 7 in a comparatively flat portion where the black stripe 20 is not formed. Therefore, a clearance 31 can further be reduced in a portion where the top 8 of the barrier rib 7 abuts on the discharging protective film 5 and an extra discharge space can further be narrowed between the adjacent unit luminescent areas EU in a direction orthogonal to the barrier rib 7. Thus, it is possible to surely prevent defective writing from being caused by erroneous discharge.

In the same manner as in the first or second embodiment described above, the convex portion of the surface of the discharging protective film 5 formed on the dielectric layer 4, which is generated due to the black stripe 20, also functions as a barrier rib for separating the discharge between the adjacent unit luminescent areas EU provided in a parallel direction with the barrier ribs 7 (that is, in a direction orthogonal to the scanning electrodes X and Y), and can also prevent defective writing from being caused by the erroneous discharge or the like between the adjacent unit luminescent areas EU.

Furthermore, the black stripe 20 is not cut into pieces. Therefore, even if a shift of alignment occurs, reliable light shielding properties can also be kept.

While the case where the discharging protective film 5 is formed on the surface of the dielectric layer 4 has been described in the above-mentioned first to third embodiments, the discharging protective film 5 is not always essential and is not formed in some cases.

INDUSTRIAL AVAILABILITY

The surface discharge type PDP according to the present invention is the most suitable for implementing a PDP to be used as a display device in a personal computer and an office workstation whose technology has remarkably been developed in recent years, a wall-mounted television receiver which has been expected to be developed in the future, and the like.

What is claimed is:

1. A surface discharge type plasma display panel comprising:

a first glass substrate having a plurality of scanning electrode pairs parallel with each other, extending in a horizontal direction, and black stripes parallel with said plurality of scanning electrode pairs formed on one main surface thereof and having a dielectric layer covering said plurality of scanning electrode pairs and said black stripes; and a second glass substrate including a plurality of address electrodes formed in parallel with each other in a direction orthogonal to said plurality of scanning electrode pairs and having a plurality of barrier ribs spaced along said horizontal direction and parallel with said plurality of address electrodes, said plurality of barrier ribs abutting on said dielectric layer to form discharge spaces each corresponding to one of said plurality of address electrodes, wherein each of said black stripes formed on said first glass substrate has a plurality of portions that each cover a two-dimensional region having a dimension along said horizontal direction that is substantially equal to the spacing between adjacent barrier ribs.

2. The surface discharge type plasma display panel according to claim 1, wherein black stripes formed on said first glass substrate include a plurality of layers, at least one of said plurality of layers having a plurality of portions that each cover a two-dimensional region having a dimension along said horizontal direction that is substantially equal to the spacing between adjacent barrier ribs.

3. The plasma display panel according to claim 2, wherein a discharging protective film is formed on a surface of said dielectric layer.

4. The plasma display panel according to claim 2, wherein said top of said each one of said plurality of barrier ribs is formed by a layer mixed with a black pigment.

5. The plasma display panel according to claim 1, wherein a discharging protective film is formed on a surface of said dielectric layer.

6. The plasma display panel according to claim 1, wherein said top of said each one of said plurality of barrier ribs is formed by a layer mixed with a black pigment.

7. A plasma display panel comprising:

a first glass substrate having a plurality of scanning electrode pairs parallel with each other and black stripes parallel with said plurality of scanning electrode pairs formed on one main surface thereof and having a dielectric layer covering said plurality of scanning electrode pairs and said black stripes; and a second glass substrate including a plurality of address electrodes formed in parallel with each other in a direction orthogonal to said plurality of scanning electrode pairs and having a plurality of barrier ribs parallel with said plurality of address electrodes, said plurality of barrier ribs abutting on said dielectric layer to form discharge spaces each corresponding to one of said plurality of address electrodes, wherein a top of each one of said plurality of barrier ribs provided on said second glass substrate includes notch portions formed in portions intersecting with said black stripes so that convex portions of said dielectric layer generated due to said black stripes formed on said first glass substrate are fitted in said notch portions.

8. The plasma display panel according to claim 7, wherein a discharging protective film is formed on a surface of said dielectric layer.

9. The plasma display panel according to claim 7, wherein said top of said each one of said plurality of barrier ribs is formed by a layer mixed with a black pigment.

10. A surface discharge type plasma display panel comprising:

a first substrate;

a plurality of scanning electrode pairs, in parallel with each other and extending in a horizontal direction, on a surface of said first substrate;

a plurality of black stripe portions;

a dielectric layer covering said plurality of electrode pairs and said plurality of black stripe portions;

a second substrate, opposite to said first substrate;

a plurality of barrier ribs spaced along said horizontal direction above a surface of said second substrate and abutting said dielectric layer to form discharge spaces of said display panel, said plurality of barrier ribs being orthogonal to said plurality of scanning electrode pairs; and a plurality of address electrodes, in parallel with each other in a direction orthogonal to said plurality of scanning electrode pairs, wherein each of said plurality of black stripe portions is positioned between adjacent barrier ribs so as to cover a two-dimensional region having a dimension along said horizontal direction that is substantially equal to the spacing between adjacent barrier ribs but not extend over said adjacent barrier ribs.

11. The surface discharge type plasma display panel according to claim 10, further comprising:

a plurality of uncut black stripes, in parallel with said scanning electrode pairs and positioned so as to overlap said plurality of barrier ribs, said black stripe portions being stacked over said plurality of uncut black stripes.

12. The surface discharge type plasma display panel according to claim 11, wherein a top surface of each of said plurality of barrier ribs is formed by a layer mixed with a black pigment.

13. The surface discharge type plasma display panel according to claim 11, wherein a discharging protective film is formed on a surface of said dielectric layer.

14. The surface discharge type plasma display panel according to claim 10, wherein a top surface of each of said plurality of barrier ribs is formed by a layer mixed with a black pigment.

15. The surface discharge type plasma display panel according to claim 10, wherein a discharging protective film is formed on a surface of said dielectric layer.

* * * * *